United States Patent [19]

Bertolini

[11] Patent Number: 4,860,913

[45] Date of Patent: Aug. 29, 1989

[54] CABINET RESTRAINT SYSTEM FOR CARGO CONTAINER

[76] Inventor: William A. Bertolini, 805 S. 295th Pl., Federal Way, Wash. 98003

[21] Appl. No.: 231,216

[22] Filed: Aug. 11, 1988

[51] Int. Cl.[4] ..... B65D 88/00

[52] U.S. Cl. ..... 220/1.5; 410/122; 410/145; 410/155

[58] Field of Search ..... 410/122, 145, 155; 220/1.5, 23.83

[56] References Cited

U.S. PATENT DOCUMENTS

| | | | |
|---|---|---|---|
| Re. 22,507 | 6/1944 | Hegis | 410/155 |
| 1,833,016 | 11/1931 | Chandler | 220/1.5 |
| 2,608,166 | 8/1952 | Pierce | 410/155 |
| 2,821,153 | 1/1958 | Canepa | 410/123 |
| 4,334,812 | 6/1982 | Delatush | 220/1.5 |
| 4,599,040 | 7/1986 | Rasmussen | 220/1.5 |

*Primary Examiner*—A. Michael Chambers
*Attorney, Agent, or Firm*—Joan H. Pauly

[57] ABSTRACT

Cabinet units (26,28) are installed in a cargo container (2) and fully integrated into the container structure to enable them to withstand transportation forces. Each cabinet unit (26,28) includes a lower cabinet (26) and an attached upper cabinet (28). The units (26,28) are arranged in opposite rows along the container sidewalls (4). Adjacent units (26,28) are attached to each other. Each unit (26,28) is attached to an angle anchor beam (58) secured to the container floor (16) and to rails (88) secured to the container sidewalls (4). The frontmost units (26,28) abut the container front wall (10). Acceleration forces are transmitted from the cabinets (26,28) through a header (14) positioned above the container door (12) to the container structure. The rearmost upper cabinet (28) of each row has secured thereto a cabinet support member (116) which rotatably carries a screw (130). The screw (130) is rotated to abut a member (136) that engages the header (14) to provide a continuous load path for transmitting the forces.

25 Claims, 8 Drawing Sheets

8
8

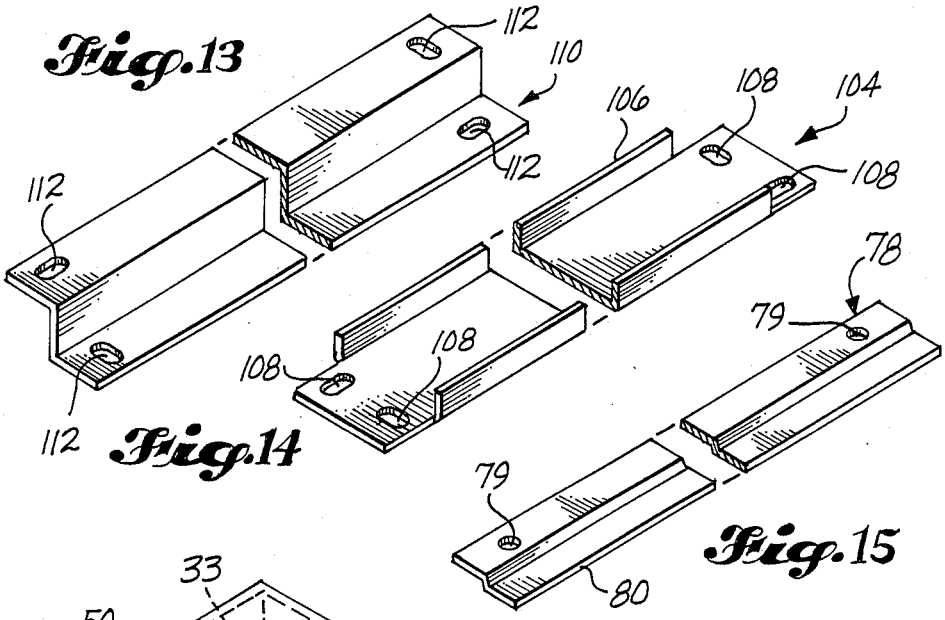
Fig.13
Fig.14
Fig.15
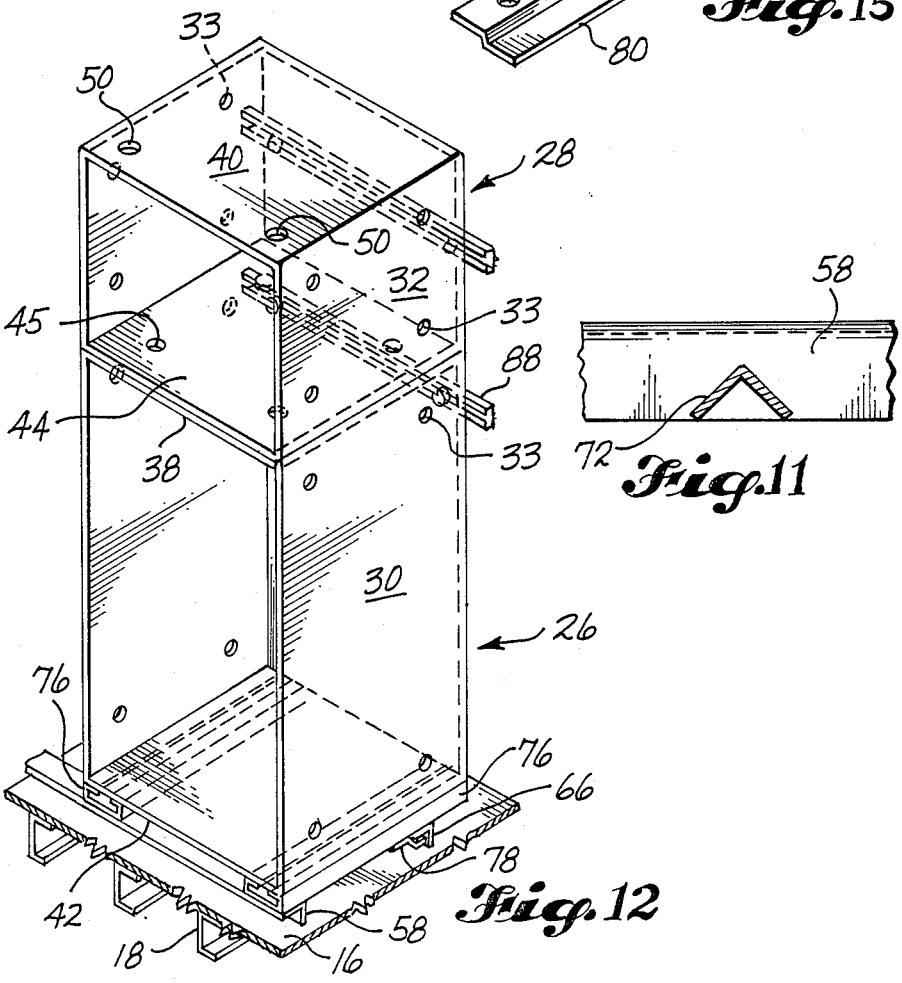
Fig.11
Fig.12

CABINET RESTRAINT SYSTEM FOR CARGO CONTAINER

TECHNICAL FIELD

This invention relates to systems for transporting small items of cargo organized for quick access and use upon arrival at a destination and, more particularly, to such a system in which a plurality of storage cabinets are installed in a cargo container and are integrated into the structure of the container to enable them to maintain their positioning and shape when the container is subjected to external forces during transportation of the container.

BACKGROUND ART

In recent years, the United States military establishment has recognized the importance of being able to quickly transport equipment and supplies to, and set up operations in, trouble spots. In order to accomplish the desired rapid transport, there is a need to containerize logistic support systems to be compatible with the current national and international maritime infrastructure. A full logistic support system includes a variety of small stores. The military has developed a plan to transport small stores in cargo containers that have been fitted with special steel cabinets.

A problem that must be solved in connection with containers fitted with such cabinets is that the cabinets, and thus the stores contained therein, are subject to being damaged by external forces to which the container is subjected during transportation of the container. The containers will be shipped by air, sea, rail, and road. The rail mode of transportation is particularly hard on containers and will create extremely high loadings on the cabinets and their support systems. Containers normally have full opening rear doors. These doors and the manufacturing tolerances of the containers and the cabinets make it impractical to firmly abut the cabinets against the rear structure of the container. Instead, they are abutted against the front wall of the container, leaving some clearance at the rear. Therefore, the rear cabinets are spaced inwardly from the rear container structure. This spacing makes the cabinets vulnerable to forces on the container tending to accelerate the container in a forward direction. When of sufficient magnitude and suddenness, such forces can deform the cabinets and thereby damage the stores contained in the cabinets and/or impede access to the stores. As used herein, the phrase "forces tending to accelerate the container in a forward direction" and like phrases include a force striking the rear of a stationary container, a force that slows the speed of a container moving with its rear facing the direction of motion, and other forces that result in the cabinets tending to move rearwardly relative to the container.

DISCLOSURE OF THE INVENTION

A subject of the invention is a system for installing storage cabinets in a cargo container and integrating the cabinets into the structure of the container to enable them to maintain their positioning and shape when the container is subjected to external forces during transportation of the container. The container has opposite sidewalls, a front wall, a floor, a rear door, and a header extending laterally substantially above the door. According to an aspect of the invention the system comprises a row of cabinets each of which has a rear wall, opposite sidewalls, a bottom wall, a top wall, and front closure means. The cabinets are arranged adjacent to each other with their rear walls adjacent to the inner surface of one of the sidewalls of the container, a sidewall of the frontmost cabinet adjacent to the front wall of the container, and the rearmost cabinet spaced inwardly from the door and the header. First, second, and third attaching means attach the rear walls of the cabinets to the adjacent sidewall of the container, adjacent sidewalls of the cabinets to each other, and the bottom walls of the cabinets to the floor, respectively. Force transmitting means is provided for transmitting forces from the cabinets to the header to provide a continuous load path from the cabinets through the header to the structure of the container to prevent deformation of the cabinets when the container is subjected to forces tending to accelerate it in a forward direction. The force transmitting means comprises a cabinet support portion, a header portion and means for adjusting. The cabinet support portion engages an upper portion of the rearmost cabinet. The header portion engages the header and the cabinet support portion. The means for adjusting adjusts the overall length of the cabinet support portion and the header portion to accommodate variations in the space between the header and the rearmost cabinet.

The system preferably comprises two such rows of cabinets arranged with their rear walls adjacent to opposite sidewalls of the container and their facing front closure means spaced from each other. The system further comprises a plurality of struts extending laterally of the container and engaging an upper portion of a cabinet in each row. The force transmitting means comprises a cabinet support portion, a header portion, and means for adjusting corresponding to each row of cabinets. Preferably, each of the struts is secured to adjacent corner portions of adjacent cabinets in each row, This preferred arrangement of the struts simplifies the overall structure of the system and helps maximize the effectiveness of the struts by causing them to act on the strongest portions of the cabinets, the corners.

A preferred feature of the system is the formation of each cabinet from an upper cabinet portion and a lower cabinet portion. The top wall of the lower cabinet portion is attached to the bottom wall of the upper cabinet portion to form the cabinet. The cabinet support portion of the force transmitting means engages an upper portion of the upper cabinet portion of the rearmost cabinet.

The means for adjusting preferably comprises a screw that is threadedly carried by one of the cabinet support portion and the header portion of the force transmitting means, and that has a head that abuts the other of the cabinet support portion and the header portion. The longitudinal axis of the screw is preferably substantially aligned with the rear and laterally inward vertical edge, relative to the container, of the rearmost cabinet. In the preferred embodiment, the cabinet support portion has a horizontal flange that is secured to the top wall of the rearmost cabinet, and a vertical flange that abuts the rearwardly facing sidewall of the rearmost cabinet and has an internally threaded sleeve projecting therefrom for threadedly receiving the screw; and the header portion comprises a forwardly projecting annular lip for surroundedly receiving a rear portion of the screw head. The preferred construction of the force transmitting means has the advantages of being relatively simple in structure and relatively easy and inexpensive to manufacture, install, and maintain. The preferred alignment of the screw axis with the cabinet edge maximizes the effectiveness of the force transmitting means since it concentrates the transmitted force near the very corner of the cabinet which is the hardest and strongest point of the cabinet.

Another preferred feature of the invention is a first attaching means that comprises a plurality of bolt members and a horizontally extending rail. The bolt members each have a shaft and a head. The rail is secured to the sidewall of the container adjacent to the rear walls of the cabinets. The rail forms a horizontal channel and a horizontal slot communicating with the channel. The bolt members are dimensioned to be positioned with their heads slidably received in the channel and their shafts projecting therefrom through the slot. The rail has two vertical lips defining the slot for retaining the heads of the bolt members in the channel. The first attaching means also includes portions of the rear wall of each cabinet forming at least one vertically elongated hole for receiving the shaft of one of the bolt members, and means for retaining the shaft in the hole. This preferred form of the first attaching means has the advantage of securely attaching the cabinets to the container sidewall while readily accommodating adjustment of the cabinet positions along the sidewall and compensating for slight vertical misalignments between the holes in the rear walls of the cabinets and the rail. The adjustability of the cabinet positions permits cabinets of various widths to be installed in the container without altering the support structure (the rail) carried by the container.

Still another preferred feature of the invention is a third attaching means that comprises a restraint beam and an anchor beam. The restraint beam extends rearwardly along and is secured to the floor of the container and has a horizontal upper flange projecting laterally inwardly therefrom. The anchor beam is spaced laterally inwardly from and extends substantially parallel to the restraint beam and is secured to the container floor. The bottom walls of the cabinets are secured to the anchor beam. The cabinet bottom walls also carry means for slidably engaging a bottom surface of the upper flange. This preferred configuration of the third attaching means has the advantages of being relatively simple in structure, of securely attaching the cabinets to the container floor and vertically restraining both front and rear portions of the cabinets, and of readily accommodating minor misalignments of the restraint beam and the anchor beam with respect to each other and with respect to the engaging means carried by the cabinets. The accommodation of misalignments helps to reduce the cost of installing the beams in the container and manufacturing the cabinets and to increase the ease of installation of the cabinets in the container.

Another subject of the invention is a method of installing storage cabinets in a cargo container and of integrating the cabinets into the structure of the container to enable them to maintain their positioning and shape when the container is subjected to external forces during transportation of the container. The cabinets are arranged and attached to the floor and a sidewall of the container, and to each other, as described above. The method also comprises positioning a first force transmitting member to engage an upper portion of the rearmost cabinet and a second force transmitting member to engage the header and the first force transmitting member. This positioning includes adjusting the overall length of the members to accommodate variations in the space between the header and the rearmost cabinet, to provide a continuous load path as described above. The method may further comprise additional steps corresponding to some or all of the preferred features discussed above in connection with the system of the invention.

The method and apparatus of the invention efficiently and economically accomplish the purpose of integrating cabinets into the structure of a cargo container. Cabinets integrated into a container structure in accordance with the invention resist forces from all directions acting on the container. In particular, the method and apparatus of the invention provide a solution to the problem of the tendency of the cabinets to deform when the container is subjected to forward acceleration forces. The apparatus of the invention is relatively simple in structure and inexpensive to provide and maintain, and the method may be relatively easy and quickly carried out. The preferred two-row arrangement helps to maximize the use of the available space inside the container. The preferred upper and lower cabinet configuration greatly increases the versatility of the system.

These and other advantages and features will become apparent from the detailed description of the best mode for carrying out the invention that follows.

BRIEF DESCRIPTION OF THE DRAWINGS

In the drawings, like element designations refer to like parts throughout, and:

In FIG. 3, the front closure means of the upper cabinets have been omitted to more clearly illustrate the cabinet deformation.

FIG. 11 is a sectional view taken along the line 11—11 in FIG. 10, with the cabinet and floor supporting structure omitted.

FIG. 12 is a pictorial view of one cabinet unit and its associated supporting structure, with the cabinet fronts, adjacent cabinets, and the fasteners between the upper and lower cabinets omitted.

FIG. 13 is a pictorial view of the lateral strut that is attached to adjacent cabinets of differing heights.

FIG. 14 is a pictorial view of the lateral strut for adjacent cabinets of the same height.

FIG. 15 is a pictorial view of the angle engaging member carried by the bottom wall of each cabinet.

BEST MODE FOR CARRYING OUT THE INVENTION

Figure 1:
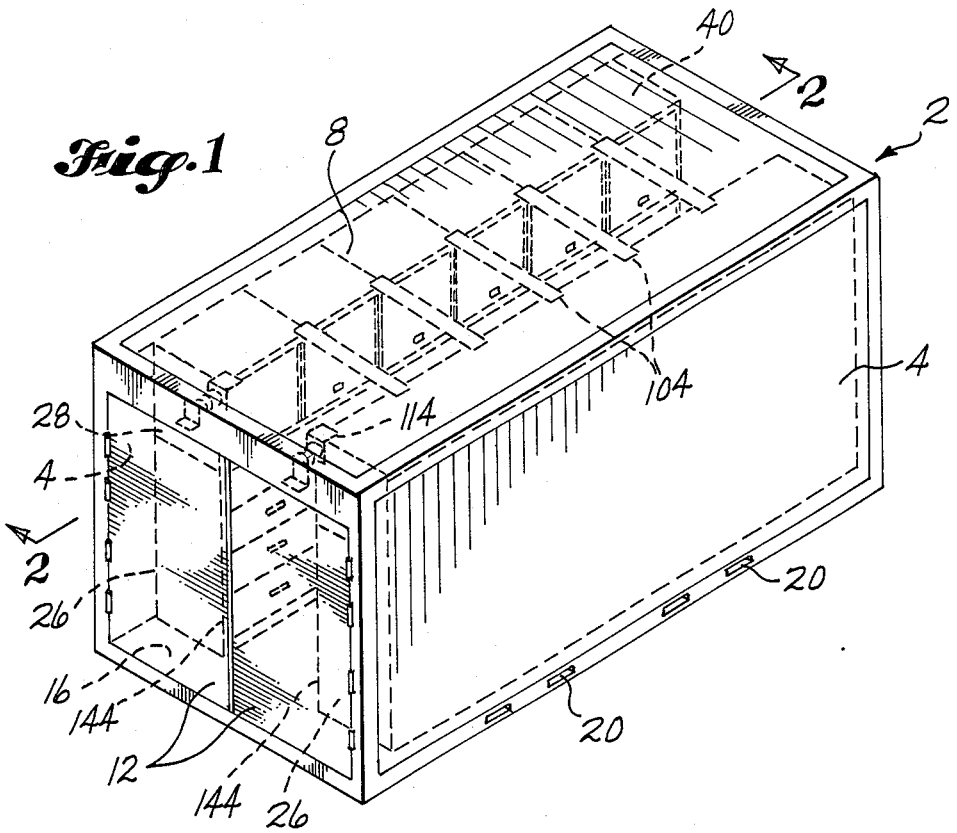
FIG. 1 is a pictorial view of a cargo container having cabinets installed therein in accordance with the preferred embodiment of the invention.

The drawings show apparatus that is constructed according to the invention and that also constitutes the best mode of the apparatus of the invention currently known to the applicant. The drawings also illustrate the best mode for carrying out the method of the invention currently known to the applicant. The drawings show cabinets 26,28 installed in a cargo container 2. It is anticipated that the primary application of the invention will be in installations such as that shown in the drawings. However, it is of course to be understood that other types and sizes of cabinets could be installed in the container 2 and cabinets could be installed in other types and sizes of containers without departing from the spirit and scope of the invention.

Figure 2:
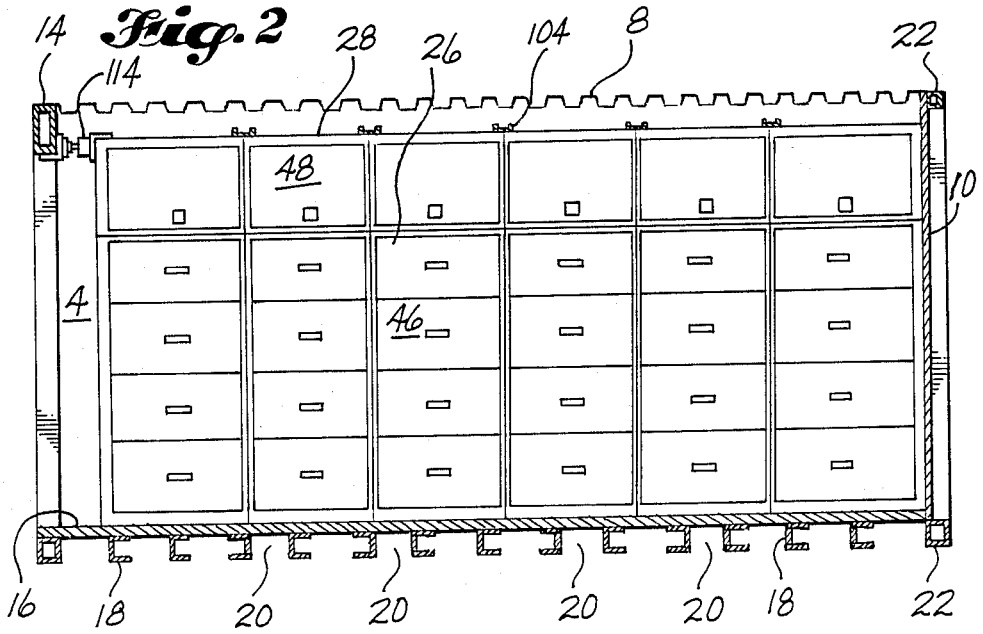
FIG. 2 is a vertical sectional view taken substantially along the line 2—2 in FIG. 1, with the container door omitted.
Figure 3:
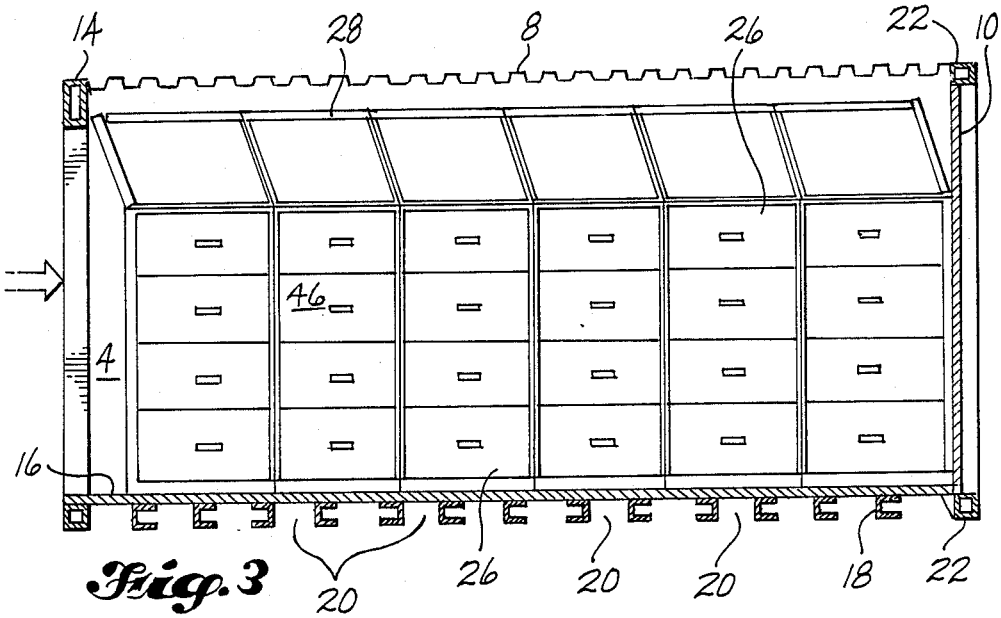
FIG. 3 is like FIG. 2 except that it illustrates the deformation of the upper cabinets when the force transmitting means is absent and the container is subjected to forward acceleration.

Referring to FIGS. 1–3, the container 2 has opposite sidewalls 4, a roof 8, a front wall 10, and a floor 16. The rear of the container 2 has a full opening door 12 of a conventional type. The door 12 has two halves that are hinged to opposite sides of the rear container structure (FIG. 1). A header 14 extends laterally across the upper rear end of the container 2 and is positioned substantially above the door 12. Cross channel members 18 are positioned on the bottom, outer surface of the floor 16 and extend laterally of the container 2. These channel members 18 form four slots 20 for receiving the tines of two sizes of standard forklifts. The corners of the container 2 are reinforced with corner support structures 22.

The cabinets 26, 28 are arranged in the container 2 in two rows, one extending along the interior surface of each of the sidewalls 4 of the container 2. The rear or back walls 34,36 of the cabinets 26,28 are adjacent to and attached to the corresponding container sidewall 4. The forwardly facing sidewall 30,32 of the frontmost cabinet 26,28 is adjacent to the front wall 10 of the container 2. The rearmost cabinet 26,28 is spaced inwardly from the door 12 and the header 14. The facing fronts 46,48 of the cabinets 26,28 are laterally spaced from each other. This arrangement makes maximum use of the available space inside the container 2 and provides easy access to the articles stored inside the cabinets 26,28.

Figures 7, 8:
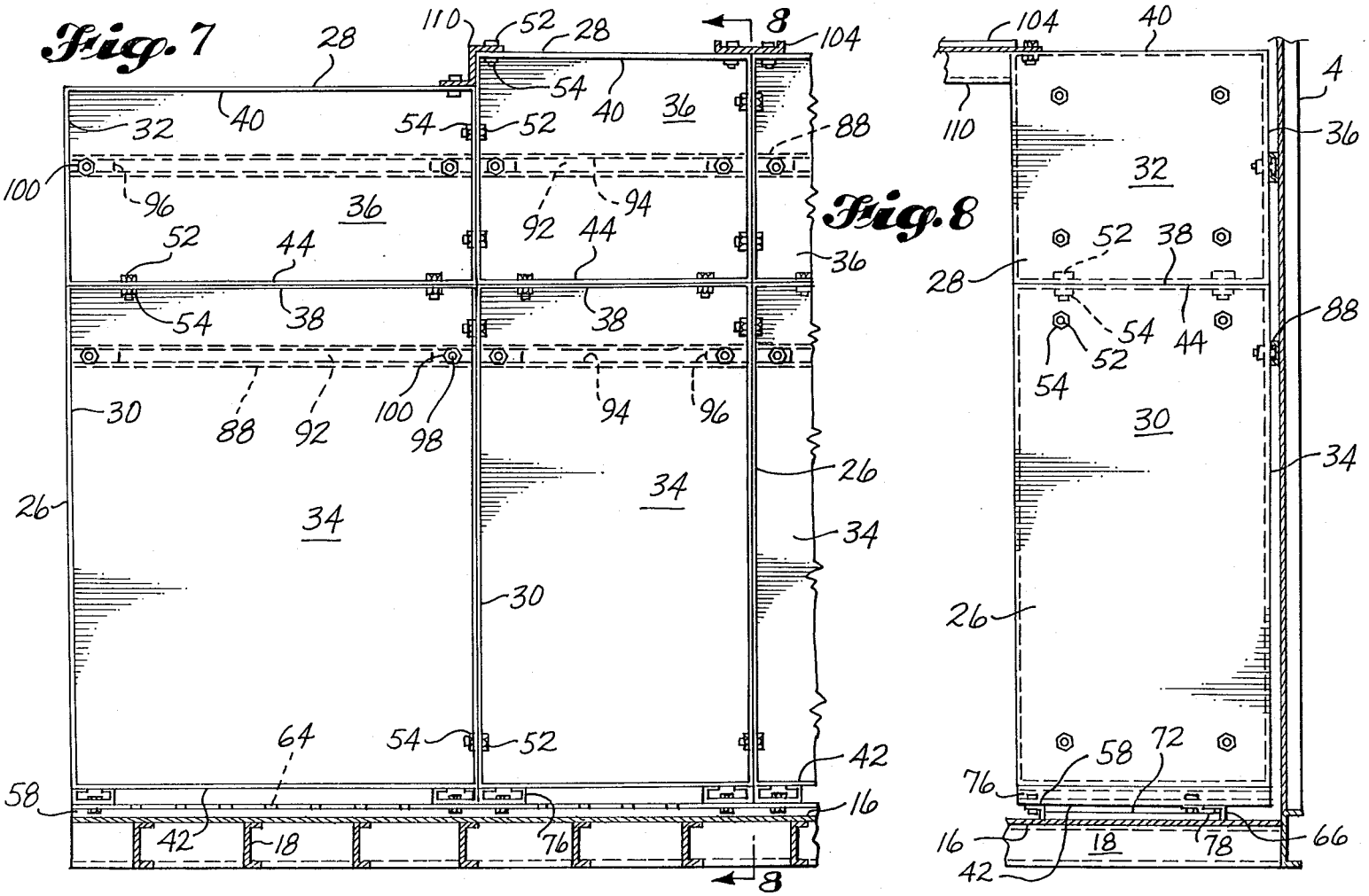
FIG. 7 is a sectional view taken along the line 7—7 in FIG. 6, with the fronts of the cabinets omitted.
FIG. 8 is a sectional view taken along the line 8—8 in FIG. 7.

The illustrated cabinet arrangement may be viewed as two rows of cabinet units 26,28, each of which has a rear wall 34,36, opposite sidewalls 30,32, a bottom wall 42, a top wall 40, and front closure means 46,48. Each cabinet unit 26,28 includes a lower cabinet 26 and a smaller upper cabinet 28. The bottom wall 42 of the lower cabinet 26 forms the bottom wall 42 of the cabinet unit 26,28. The top wall 40 of the upper cabinet 28 forms the top wall 40 of the cabinet unit 26,28. The top wall 38 of the lower cabinet 26 is attached to the bottom wall 44 of the upper cabinet 28 to form the cabinet unit 26,28. The attachment is accomplished by means of bolts 52 and locknuts 54 (FIGS. 7 and 8). The cabinets 26,28 are similar to standard metal cabinets but are formed from heavier steel for strength. The lower cabinets 26 have sliding drawers with front closure members 46. The upper cabinets 28 have front doors 48 that lift up and slide inwardly in the manner of the glass doors of a lawyer's bookcase.

Each cabinet unit 26,28 is attached to a sidewall 4 and the floor 16 of the container 2. In addition, the sidewalls 30,32 of adjacent cabinets 26,28 are attached to each other. The latter attachments are accomplished by bolts 52 that are received into aligned holes 33 (FIG. 12) in the cabinet sidewalls 30,32 and are secured in position by locknuts 54, as shown in FIGS. 7 and 8. The bolts 52 and holes 33 are dimensioned to accommodate minor misalignments of the holes 33. For example, 7/16 inch bolts may be used with 9/16 inch holes.

Figure 6:
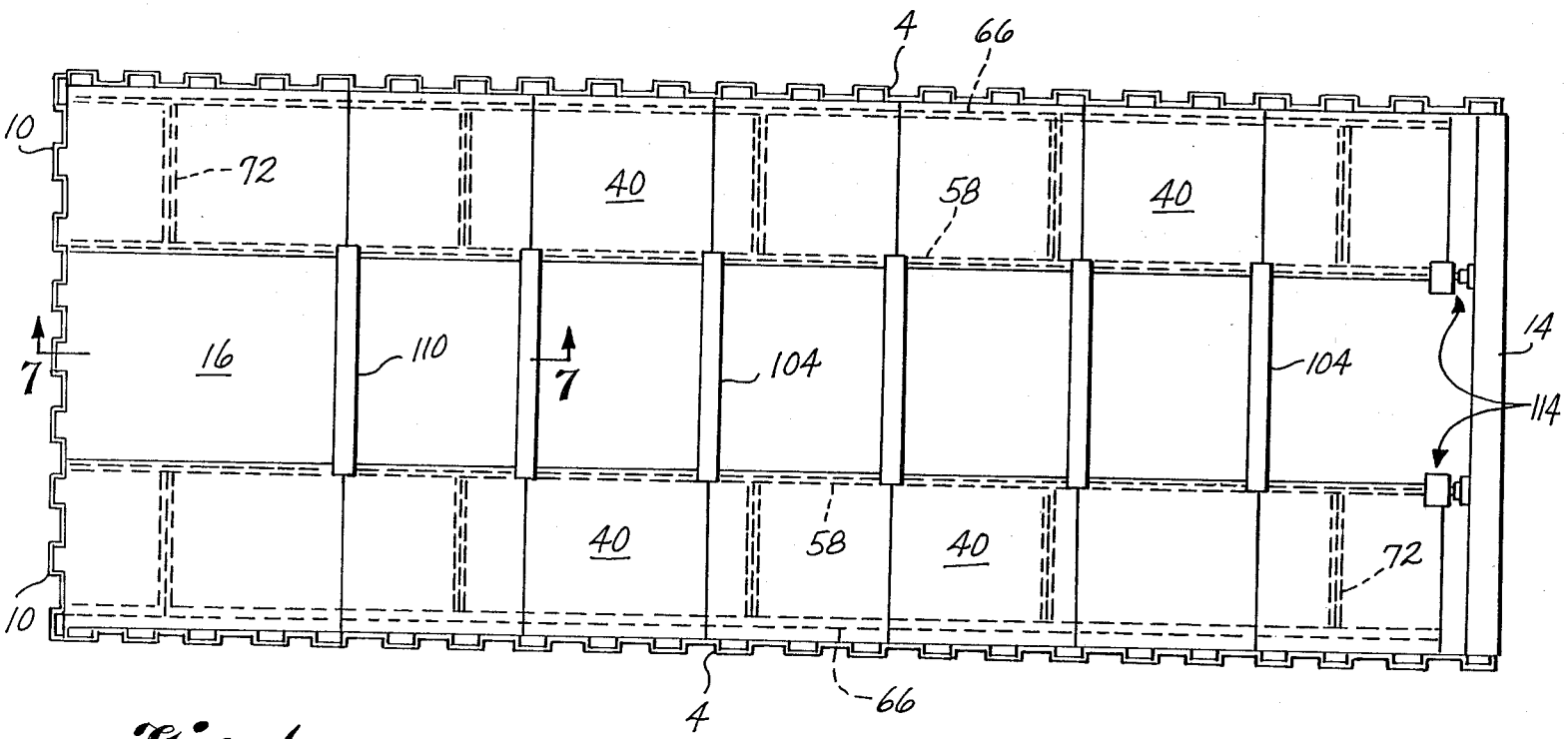
FIG. 6 is a top plan view of the container shown in FIG. 1, with upper foreground portions of the container omitted.
Figure 10:
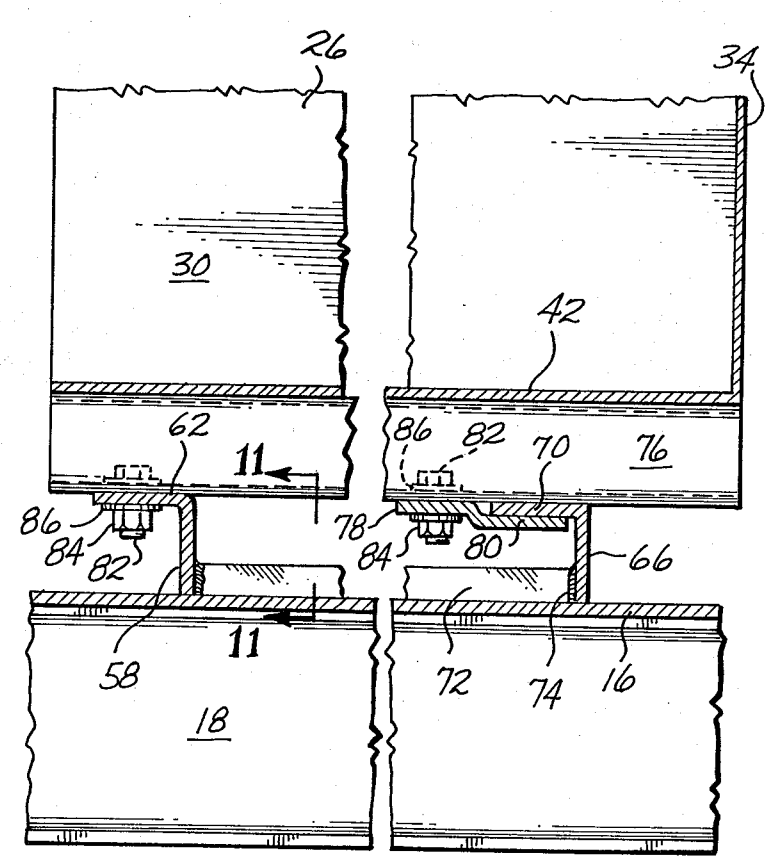
FIG. 10 is an enlarged fragmentary view of bottom portions of FIG. 8.

The structure for attaching the bottom walls 42 of the cabinet units 26,28 is shown in FIGS. 6–12 and 15. The structure includes an inboard anchor beam 58 and an outboard rear restraint beam 66 on each side of the container 2. Each beam 58,66 is formed by an L-shaped angle with a vertical leg secured, such as by welding, to the floor 16 of the container 2 and a horizontal, laterally inwardly projecting leg or flange 62,70. The horizontal flange 62 of the anchor beam 58 has a plurality of longitudinally spaced predrilled holes 64 extending vertically therethrough. The holes 64 are spaced at regular intervals to provide attachment points for cabinets 26,28 of varying widths. In other words, the anchor beam 58 has a repetitive pattern of holes 64 which will accept any configuration of modular sized cabinets. FIG. 6 is a plan view which shows the arrangement of the beams 58,66 on the floor 16 of the container 2. The beams 58,66 extend rearwardly along the floor 16 from the front wall 10 of the container 2. Each anchor beam 58 is spaced laterally inwardly from and extends substantially parallel to the corresponding restraint beam 66. A plurality of tie beams 72 extend laterally between each anchor beam 58 and corresponding restraint beam 66, as shown in FIGS. 6, 8, and 10. The tie beams 72 are welded to the anchor and restraint beams 58,66, as shown at 74 in FIG. 10. FIG. 11 shows the cross-sectional shape of a tie beam 72.

Figure 9:
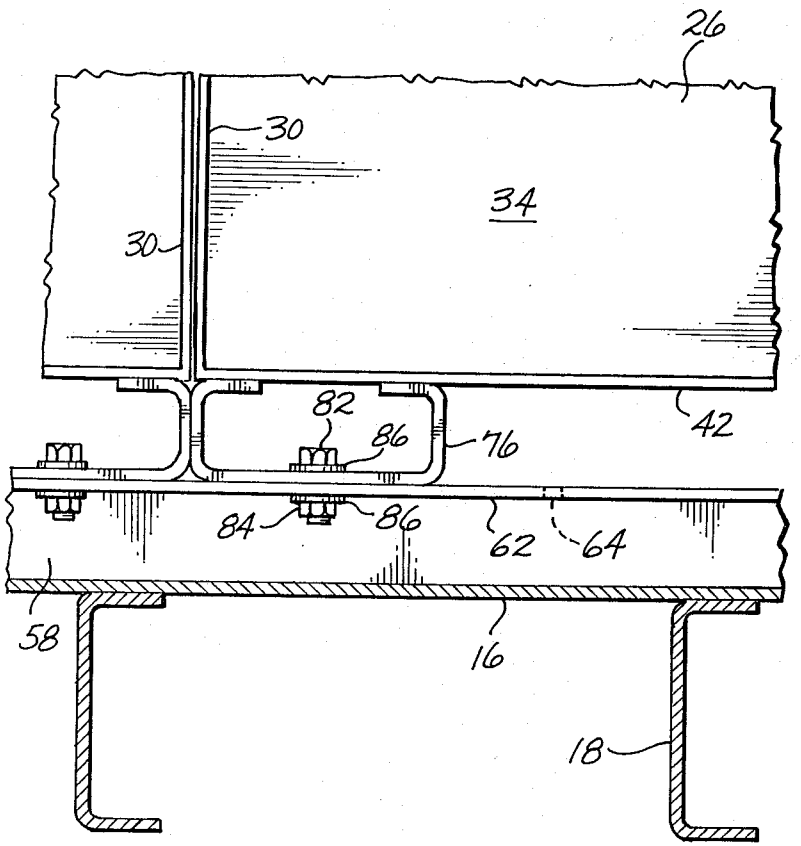
FIG. 9 is an enlarged fragmentary view of a bottom portion of FIG. 7.
Figure 16:
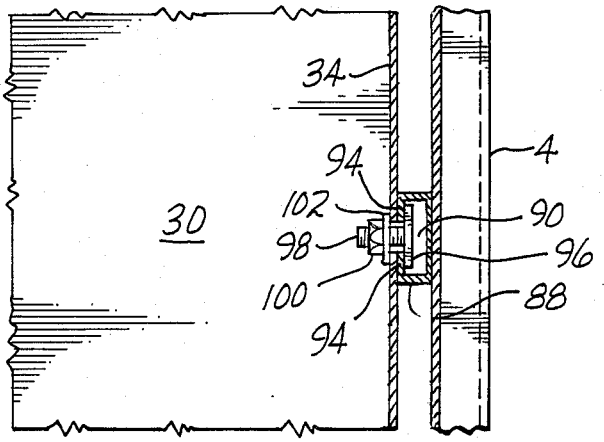
FIG. 16 is a vertical sectional view of one of the connections between a rear cabinet wall and a container sidewall.

The bottom of each cabinet unit 26,28 is secured to the corresponding anchor beam 58 and slidably engages the bottom surface of the horizontal upper flange 70 of the corresponding restraint beam 66. As best seen in FIGS. 9, 10, and 12, a C-shaped channel or pallet base 76 runs along each side edge portion of the bottom wall 42 of each cabinet unit 26,28. The channels 76 are secured to the bottom walls 42 by suitable means, such as welding. The bottom wall 42 of each cabinet unit 26,28 is secured to the corresponding anchor beam 58 by means of bolts 82 that extend through holes in the channels 76 and aligned holes 64 in the upper flange 62 of the anchor beam 58. The bolts 82 are secured by locknuts 84 and washers 86. An angle engaging member or cabinet stay 78 is also secured to the channels 76 by a similar fastening arrangement. The positioning of the cabinet stay 78 is shown in FIGS. 8, 10, and 12, and the structure of the stay 78 itself is shown in FIG. 15. The stay 78 has holes 79 extending therethrough for receiving the bolts 82. The stay 78 has an elongated finger portion 80 that is vertically downwardly offset from the portion which is attached to the channels 76 for slidably engaging the bottom surface of the upper flange 70 of the restraint beam 66, as shown in FIGS. 8, 10, and 12.

The attachment of the rear cabinet walls 34,36 to the sidewalls 4 of the container 2 is shown in FIGS. 7, 8, 12, 16, and 17. The attaching means includes a pair of vertically spaced horizontally extending rails 88 secured to each sidewall 4 of the container 2, one adjacent to the rear walls 34 of the lower cabinets 26 of the cabinet units 26,28 and one adjacent to the rear walls 36 of the upper cabinets 28. Each rail 88 may be continuous, as shown in the drawings, or formed from a plurality of separate segments. The upper rail 88 may be omitted. It is contemplated that for most applications a single rail 88 on each sidewall 4 positioned to engage the lower cabinets 26 will be sufficient. For applications in which service conditions are especially severe, the two-rail arrangement shown in FIGS. 7, 8, and 12 is preferred since it provides additional strength.

Figure 17:
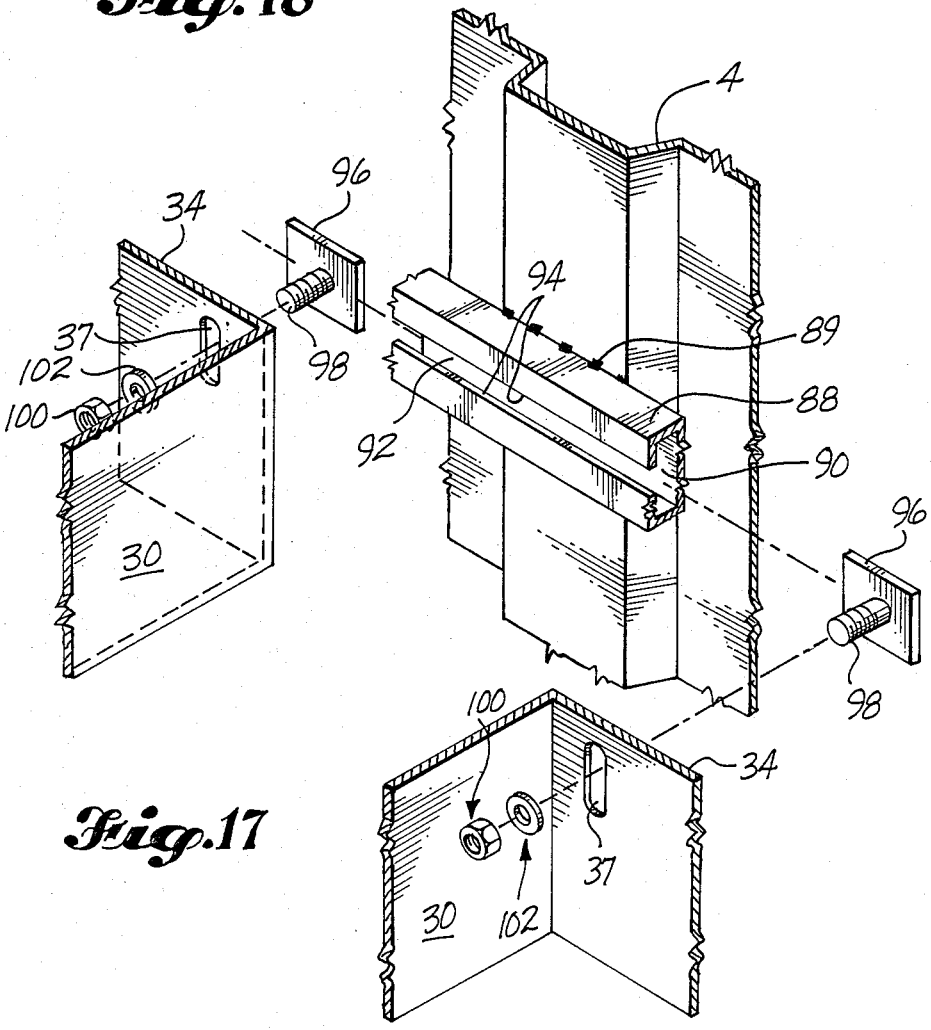
FIG. 17 is an exploded pictorial view of the structure shown in FIG. 16.

Each rail 88 forms a horizontal channel 90 and a horizontal slot 92 communicating with the channel 90. The adjacent rear wall 34,36 of each cabinet portion 26,28 has two horizontally spaced, vertically elongated holes 37 formed therein (FIG. 17). A bolt 96,98 engages each of the holes 37 and the corresponding rail 88. The bolt 96,98 has a flat, rectangular head 96 and a threaded shaft 98. The head 96 is dimensioned to be slidably received in the channel 90 with the shaft 98 projecting therefrom through the slot 92. The rail 88 has two opposite vertical lips 94 that define the slot 92 and retain the heads 96 of the bolts 96,98 in the channel 90. A locknut 100 and washer 102 retain the bolt shaft 98 in the hole 37 to firmly attach the rear cabinet wall 34,36 to the rail 88.

The cabinet restraint apparatus also includes lateral struts 104,110 for bracing the cabinet units 26,28 against laterally directed forces on the container 2. The positioning of the struts 104,110 is shown in FIGS. 1, 2, and 6–8. The structures of the struts 104,110 are best seen in FIGS. 13 and 14. Each strut 104,110 extends laterally between the rows of cabinet units 26,28 and engages adjacent upper corner portions of adjacent units 26,28 in each row, as shown in FIGS. 1, 2, and 6. In most installations, at least most of the adjacent cabinet units 26,28 will be the same height and will be engaged by the common strut 104 shown in FIG. 14. The forwardmost upper cabinet 28 shown at the left of FIG. 7 is reduced in height to clear a protuberance in the container 2 created by a corner casting of a known type that is used for securing the container 2 to another structure. Therefore, the cabinet 28 requires an alternative end strut 110 described below.

The common strut 104 has a main horizontal portion and vertically upwardly directed stiffeners 106. Four holes 108 are formed in the horizontal portion in the pattern shown in FIG. 14. In this pattern, on one end of the strut 104, the right hole 108 is laterally elongated and the left hole is longitudinally elongated. On the other end of the strut 104, the hole pattern is reversed. Holes 50 (FIG. 12) are provided in the top walls 40 of the cabinet units 26,28 for attaching the struts 104. The hole pattern of the strut 104 automatically adjusts for both lateral and longitudinal misalignment of the strut 104 with respect to the holes 50. An end strut 110 is shown in FIG. 13 and is used for laterally bracing adjacent units 26,28 of differing heights. As can be seen in FIGS. 7 and 13, the strut 110 has a Z-shaped cross section to accommodate the differing heights The strut 110 has holes 112 arranged in the same pattern as the holes 108 in the strut 104 for attaching it to the cabinet unit top walls 40.

The cabinet support system includes force transmitting means 114 for transmitting forces from the cabinet units 26,28 to the header 14 to provide a continuous load path from the cabinet units 26,28 through the header 14 to the structure of the container 2 to prevent deformation of the cabinet units 26,28 when the container 2 is subjected to forces tending to accelerate it in a forward direction, as defined above. FIG. 3 illustrates a deformation that can occur when the force transmitting means is omitted. As can be seen in FIG. 3, the rearward acceleration of the cabinet units 26,28 relative to the container 2 causes the rectangular shape of the upper cabinets 28 of the cabinet units 26,28 to deform into a parallelogram shape. The force transmitting means of the invention prevents this type and other types of cabinet deformation.

The positioning of the force transmitting means is shown in FIGS. 1, 2, 4, and 6. The force transmitting means 114 includes a cabinet support member 116 and a shoulder plate or header member 136,138 corresponding to each row of cabinet units 26,28. The cabinet support member 116 engages an upper portion of the upper cabinet 28 of the rearmost cabinet unit 26,28. The header member 136,138 engages the header 14 and the cabinet support member 116. The force transmitting means 114 has means for adjusting the overall length of the cabinet support member 116 and the header member 136,138 to accommodate variations in the space between the header 14 and the rearmost cabinet unit 26,28. The preferred embodiment of the adjusting means is a screw 130 that is threadedly and rotatably carried by cabinet support member 116 and has a head 134 that abuts the header member 136,138. Preferably, the longitudinal axis of the screw 130 is aligned with the rear and laterally inward vertical edge 144 (FIG. 1), relative to the container 2, of the rearmost cabinet unit 26,28 to transmit forces through the strongest portion of the cabinet unit 26,28. Because of this alignment, the cabinet support member 116 projects laterally inwardly from the face of the cabinet unit 26,28, as shown in FIGS. 1 and 6.

Figure 4:
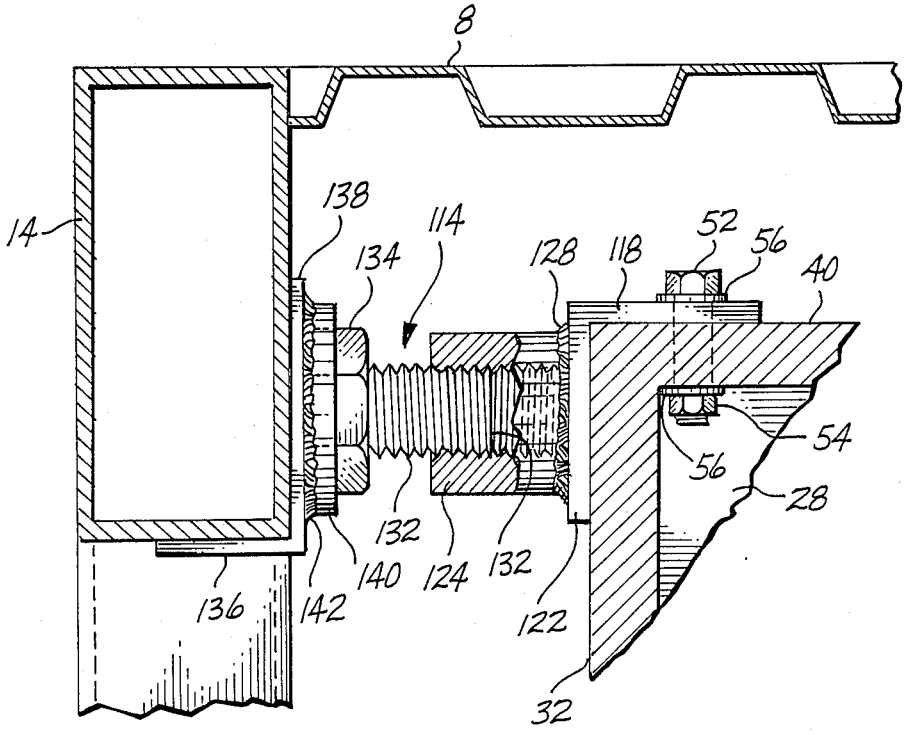
FIG. 4 is an enlarged fragmentary view of the upper left portion of FIG. 2, illustrating the force transmitting means.
Figure 5:
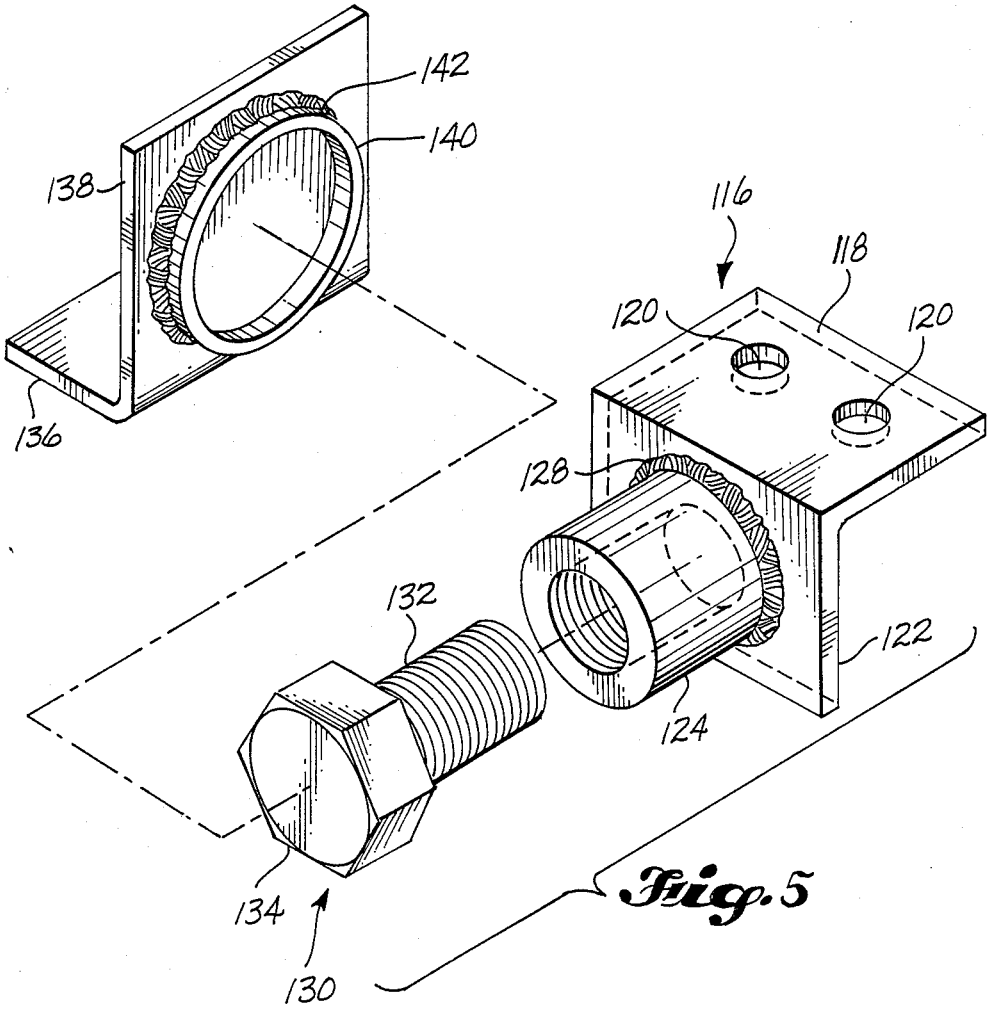
FIG. 5 is an exploded pictorial view of the force transmitting means corresponding to one row of cabinets.

The structural details of the force transmitting members 116,136,138 are best seen in FIGS. 4 and 5. The cabinet support member 116 has a horizontal flange 118 with two holes 120 extending therethrough The holes 120 provide a means for attaching the flange 118 to the upper cabinet wall 40. Only one of the holes 120 is used in a particular installation with the two holes 120 permitting an individual cabinet support member 116 to be installed on the rearmost cabinet unit 26,28 of either the left or right row of cabinet units 26,28. The cabinet support member 116 also has a vertical flange 122 that abuts the rearwardly facing sidewall 32 of the upper cabinet 28 of the rearmost cabinet unit 26,28. The flange 122 has an internally threaded sleeve 124 projecting therefrom for threadedly receiving the threaded shaft 132 of the screw 130. The sleeve 124 is secured to the flange 122 by welding, as shown at 128 in FIGS. 4 and 5.

The header member 136,138 also has an L-shaped configuration with a horizontal flange 136 and a vertical flange 138. As best seen in FIG. 4, the vertical flange 138 abuts the forwardly facing surface of the header 14, and the lower horizontal flange 136 abuts the bottom surface of the header 14. An annular lip 140 projects forwardly from the vertical flange 138 toward the cabinet support member 116. The lip 140 is secured to the flange 138 by welding 142. The lip 140 surroundedly receives a rear portion of the screw head 134. In the installation of the cabinet units 26,28, the screw 130 is rotated until the top of the head 134 firmly abuts the vertical flange 138 inside the lip 140. As can be seen in FIG. 4, the depth of the lip 140 relative to the thickness of the head 134 is shallow so that the head 134 may be engaged by a wrench to bring it into firm abutting contact.

In the method of the invention, the cabinet units 26,28 are formed by attaching each upper cabinet 28 to its corresponding lower cabinet 26. This is accomplished by four bolt connections that engage holes 45 in the bottom wall 44 of the upper cabinet 28 and aligned holes in the top wall 38 of the lower cabinet 26. The holes 45 are positioned near the corners of the bottom wall 44 as shown in FIG. 12. The anchor beams 28 and the restraint beams 66 are permanently welded to the floor 16 of the container 2. The tie beams 72 are welded to the anchor and restraint beams 58,66 to give them a rigid frame structure. The rails 88 are also permanently installed in the container 2. The rails 88 are welded to the sidewalls 4, as shown at 89 in FIG. 17.

Before each cabinet unit 26,28 is moved into position inside the container 2, a bolt 96,98 is loosely attached to each of the four elongated holes 37 in the rear wall 34,36 of the unit 26,28. The unit 26,28 is moved into position in the container 2 by sliding it along the anchor beam 58 and restraint beam 66 on one side of the container 2. As the unit 26,28 is slid into place, the bolt heads 96 are positioned in the corresponding channels 90 of the rails 88 and slide therein as the cabinet unit 26,28 slides along the beams 58,66. The first unit 26,28 on each side is slid into the forward corner of the container 2 until it abuts the front wall 10 of the container 2. As the unit 26,28 slides along the beams 58,66, the cabinet stay 78 carried by the bottom wall 42 of the unit 26,28 slides along the lower surface of the restraint beam flange 70. The engagement between the stay 78 and the restraint beam 66 guides the sliding movement of the unit 26,28.

When the unit 26,28 is in position in the corner of the container 2, the channels 76, which are permanently attached to the bottom wall 42 of the unit 26,28, are secured to the anchor beam 58 by means of bolts 82, locknuts 84, and washers 86. As shown in FIG. 7, there are typically two channels 76 carried by the unit 26,28 and therefore two connections of the cabinet unit bottom to the anchor beam 58. The connections to the rails 88 are also secured by tightening each of the four locknuts 100. When the first unit 26,28 has been securely fastened to the anchor beam 58 and the rails 88, a second unit 26,28 is slid into position abutting the sidewall 30,32 of the first unit 26,28. When the second unit 26,28 has been positioned, it is secured to the anchor beam 58 and the rails 88, and its sidewall 30,32 is secured to the adjacent sidewall 30,32 of the first unit 26,28. The latter connection is made by an arrangement of eight bolts 52 which engage the holes 33 shown in FIG. 12. Subsequent cabinet units 26,28 are similarly positioned and secured in place until both rows of units 26,28 are complete.

When all of the units 26,28 have been positioned and secured, the struts 104,110 are put into position and secured to the top walls 40 of the units 26,28 by bolt and locknut arrangements 52,54 that engage the holes 108,112 in the struts 104,110 and the holes 50 in the top walls 40 of the units 26,28. As noted above, each of the struts 104,110 is secured to two adjacent upper corner portions of adjacent cabinet units 26,28 in each row.

The installation of the units 26,28 is completed by engaging the force transmitting means 114. A cabinet support member 116 is attached to the upper cabinet 28 of the rearmost cabinet unit 26,28 in each row. The member 116 is attached by means of a bolt 52 that engages one of the holes 120 in the member 116 and the rear hole 50 in the cabinet top wall 40. As shown in FIG. 4, the bolt 52 is secured by a locknut 54 and washers 56. With the cabinet support member 116 secured to the upper cabinet 28, the header member 136,138 is held in position relative to the header 14, as shown in FIG. 4. Then, the screw 130 is rotated until its head 134 firmly abuts the vertical surface of the header member 136,138 inside the annular lip 140. The lip 140 ensures that the force transmitting means 114 remains in operational position in the event that the header member 136,138, which is held in place by friction, shifts position. The diameter of the lip 140 is larger than the diameter of the screw head 134 to accommodate variations in the height of the cabinet unit 26,28 relative to the header 14. As can be seen in FIG. 4, the screw shaft 132 and the sleeve 124 of the cabinet support member 116 are dimensioned so that the shaft 132 has sufficient travel to allow the header member 136,138 to be put into position before the screw 130 is rotated to move it outwardly, and to accommodate variations in the horizontal distance between the header 14 and the cabinet unit 26,28. When the force transmitting means 114 is in operational position, each cabinet support member 116 projects laterally inwardly from the corresponding top cabinet wall 40, and the longitudinal axis of the screw 130 is aligned with the rear and laterally inward vertical edge 144 of the cabinet unit 26,28. As noted above, this causes the forces to be transmitted through the strongest portions of the cabinet units 26,28.

Upon completion of the installation of the cabinet units 26,28, as described above, the cabinets 26,28 are fully integrated into the structure of the container 2. The cabinets 26,28 may be filled with military stores or other articles to complete preparation for shipping the container 2. During transportation of the container 2, the integration of the cabinets 26,28 into the container structure enables them to maintain their positioning and shape when the container 2 is subjected to external forces. Regardless of the mode of transportation used, the cabinets 26,28 are able to withstand normal forces to which the container 2 is subjected during transportation. When the container 2 arrives at its destination, the cabinets 26,28 and their contents will be undamaged and ready for use.

It will be obvious to those skilled in the art to which this invention is addressed that the invention may be used to advantage in a variety of situations. Therefore, it is also to be understood by those skilled in the art that various modifications and omissions in form and detail may be made without departing from the spirit and scope of the invention as defined by the following claims.

What is claimed is:

1. A system for installing storage cabinets in a cargo container and integrating the cabinets into the structure of the container to enable them to maintain their positioning and shape when the container is subjected to external forces during transportation of the container, said container having opposite sidewalls, a front wall, a floor, a rear door, and a header extending laterally substantially above the door, said system comprising:

a row of cabinets each of which has a rear wall, opposite sidewalls, a bottom wall, a top wall, and front closure means; said cabinets being arranged adjacent to each other with their rear walls adjacent to the inner surface of one of the sidewalls of the container, a sidewall of the frontmost cabinet adjacent to the front wall of the container, and the rearmost cabinet spaced inwardly from the door and the header;

first attaching means for attaching the rear walls of the cabinets to the adjacent sidewall of the container;

second attaching means for attaching adjacent sidewalls of the cabinets to each other;

third attaching means for attaching the bottom walls of the cabinets to the floor; and force transmitting means for transmitting forces from the cabinets to the header to provide a continuous load path from the cabinets through the header to the structure of the container to prevent deformation of the cabinets when the container is subjected to forces tending to accelerate it in a forward direction; said force transmitting means comprising a cabinet support portion that engages an upper portion of the rearmost cabinet, a header portion that engages the header and the cabinet support portion, and means for adjusting the overall length of said cabinet support portion and said header portion to accommodate variations in the space between the header and the rearmost cabinet.

2. The system of claim 1, which comprises two said rows of cabinets arranged with their rear walls adjacent to opposite sidewalls of the container and their facing front closure means spaced from each other; which further comprises a plurality of struts extending laterally of the container and engaging an upper portion of a cabinet in each row; and in which the force transmitting means comprises a cabinet support portion, a header portion, and means for adjusting corresponding to each row of cabinets.

3. The system of claim 2, in which each of the struts is secured to adjacent corner portions of adjacent cabinets in each row.

4. The system of claim 1, in which each cabinet comprises an upper cabinet portion with a bottom wall and a top wall, and a lower cabinet portion with a bottom wall and a top wall attached to the bottom wall of the upper cabinet portion; said top wall of the upper cabinet portion forming the top wall of the cabinet, said bottom wall of the lower cabinet portion forming the bottom wall of the cabinet, and said cabinet support portion of the force transmitting means engaging an upper portion of the upper cabinet portion of the rearmost cabinet.

5. The system of claim 1, in which the means for adjusting comprises a screw that is threadedly carried by one of the cabinet support portion and the header portion of the force transmitting means, and that has a head that abuts the other of the cabinet support portion and the header portion.

6. The system of claim 5, in which the screw has a longitudinal axis that is substantially aligned with the rear and laterally inward vertical edge, relative to the container, of the rearmost cabinet.

7. The system of claim 6, in which the cabinet support portion has a horizontal flange that is secured to the top wall of the rearmost cabinet, and a vertical flange that abuts the rearwardly facing sidewall of the rearmost cabinet and has an internally threaded sleeve projecting therefrom for threadedly receiving the screw; and the header portion comprises a forwardly projecting annular lip for surroundedly receiving a rear portion of the screw head.

8. The system of claim 2, in which each means for adjusting comprises a screw that is threadedly carried by one of the cabinet support portion and the header portion, and that has a head that abuts the other of the cabinet support portion and the header portion.

9. The system of claim 3, in which each means for adjusting comprises a screw that is threadedly carried by one of the cabinet support portion and the header portion, and that has a head that abuts the other of the cabinet support portion and the header portion; said screw having a longitudinal axis that is substantially aligned with the rear and laterally inward vertical edge, relative to the container, of the rearmost cabinet in the corresponding row.

10. The system of claim 4, in which the means for adjusting comprises a screw that is threadedly carried by one of the cabinet support portion and the header portion of the force transmitting means, and that has a head that abuts the other of the cabinet support portion and the header portion; said screw having a longitudinal axis that is substantially aligned with the rear and laterally inward vertical edge, relative to the container, of the upper cabinet portion of the rearmost cabinet.

11. The system of claim 1, in which the first attaching means comprises a plurality of bolt members each having a shaft and a head; a horizontally extending rail secured to the sidewall of the container adjacent to the rear walls of the cabinets; said rail forming a horizontal channel and a horizontal slot communicating with the channel, said bolt members being dimensioned to be positioned with their heads slidably received in the channel and their shafts projecting therefrom through the slot, and said rail having two vertical lips defining the slot for retaining the heads of the bolt members in the channel; portions of the rear wall of each cabinet forming at least one vertically elongated hole for receiving the shaft of one of said bolt members; and means for retaining said shaft in said hole.

12. The system of claim 11, in which the means for adjusting comprises a screw that is threadedly carried by one of the cabinet support portion and the header portion of the force transmitting means, and that has a head that abuts the other of the cabinet support portion and the header portion; and the screw has a longitudinal axis that is substantially aligned with the rear and laterally inward vertical edge, relative to the container, of the rearmost cabinet.

13. The system of claim 1, in which the third attaching means comprises a restraint beam extending rearwardly along and secured to the floor and having a horizontal upper flange projecting laterally inwardly therefrom, an anchor beam spaced laterally inwardly from and extending substantially parallel to the restraint beam and secured to the floor, means for securing the bottom walls of the cabinets to the anchor beam, and means carried by the bottom walls of the cabinets for slidably engaging a bottom surface of said upper flange.

14. The system of claim 13, in which the means for adjusting comprises a screw that is threadedly carried by one of the cabinet support portion and the header portion of the force transmitting means, and that has a head that abuts the other of the cabinet support portion and the header portion; and the screw has a longitudinal axis that is substantially aligned with the rear and laterally inward vertical edge, relative to the container, of the rearmost cabinet.

15. The system of claim 11, in which the third attaching means comprises a restraint beam extending rearwardly along and secured to the floor and having a horizontal upper flange projecting laterally inwardly therefrom, an anchor beam spaced laterally inwardly from and extending substantially parallel to the restraint beam and secured to the floor, means for securing the bottom walls of the cabinets to the anchor beam, and means carried by the bottom walls of the cabinets for slidably engaging a bottom surface of said upper flange.

16. The system of claim 15, in which the means for adjusting comprises a screw that is threadedly carried by one of the cabinet support portion and the header portion of the force transmitting means, and that has a head that abuts the other of the cabinet support portion and the header portion; and the screw has a longitudinal axis that is substantially aligned with the rear and laterally inward vertical edge, relative to the container, of the rearmost cabinet.

17. A method of installing storage cabinets in a cargo container and of integrating the cabinets into the structure of the container to enable them to maintain their positioning and shape when the container is subjected to external forces during transportation of the container, said container having opposite sidewalls, a front wall, a floor, a rear door, and a header extending laterally substantially above the door, said method comprising;

providing a plurality of cabinets each of which has a rear wall, opposite sidewalls, a bottom wall, a top wall, and front closure means; and arranging said cabinets adjacent to each other in a row with their rear walls adjacent to the inner surface of one of the sidewalls of the container, a sidewall of the frontmost cabinet adjacent to the front wall of the container, and the rearmost cabinet spaced inwardly from the door and the header;

attaching the rear walls of the cabinets to the adjacent sidewall of the container;

attaching adjacent sidewalls of the cabinets to each other;

attaching the bottom walls of the cabinets to the floor; and positioning a first force transmitting member to engage an upper portion of the rearmost cabinet and a second force transmitting member to engage the header and the first force transmitting member, including adjusting the overall length of said members to accommodate variations in the space between the header and the rearmost cabinet, to provide a continuous load path from the cabinets through the header to the structure of the container to prevent deformation of the cabinets when the container is subjected to forces tending to accelerate it in a forward direction.

18. The method of claim 17, comprising arranging cabinets in two said rows with the rear walls of the cabinets in each of the rows adjacent to the inner surface of a different one of the sidewalls of the container and with the facing front closure means spaced from each other, and positioning a plurality of struts to extend laterally of the container and engage an upper portion of a cabinet in each row.

19. The method of claim 18, comprising securing each strut to adjacent corner portions of adjacent cabinets in each row.

20. The method of claim 17, in which the step of providing cabinets includes forming each cabinet from an upper cabinet with a bottom wall and a top wall and a lower cabinet with a bottom wall and a top wall, including attaching the bottom wall of the upper cabinet to the top wall of the lower cabinet.

21. The method of claim 17, in which the step of adjusting the overall length of said members includes threadedly connecting a screw with a head to one of said members, and rotating the screw to cause its head to firmly abut the other of said members.

22. The method of claim 21, comprising substantially aligning the longitudinal axis of the screw with the rear and laterally inward vertical edge, relative to the container, of the rearmost cabinet.

23. The method of claim 19, in which the step of adjusting the overall length of said members includes threadedly connecting a screw with a head to one of said members, and rotating the screw to cause its head to firmly abut the other of said members; and which comprises substantially aligning the longitudinal axis of the screw with the rear and laterally inward vertical edge, relative to the container, of the rearmost cabinet.

24. The method of claim 17, in which the step of attaching the rear walls comprises providing a rail with a horizontally extending channel and a plurality of bolts each having a head and a shaft, securing the rail to the sidewall of the container adjacent to the rear walls of the cabinets, positioning the bolts with their heads slidably received in the channel and their shafts projecting therefrom and into holes in the rear walls of the cabinets, and securing the shafts to the rear walls of the cabinets.

25. The method of claim 24, in which the step of adjusting the overall length of said members includes threadedly connecting a screw with a head to one of said members, and rotating the screw to cause its head to firmly abut the other of said members; and which comprises substantially aligning the longitudinal axis of the screw with the rear and laterally inward vertical edge, relative to the container, of the rearmost cabinet.

* * * * *